US010336526B1

(12) United States Patent
Strong

(10) Patent No.: US 10,336,526 B1
(45) Date of Patent: Jul. 2, 2019

(54) CHAMPAGNE SPRAYER

(71) Applicant: Stason Strong, Playa Del Rey, CA (US)

(72) Inventor: Stason Strong, Playa Del Rey, CA (US)

( * ) Notice: Subject to any disclaimer, the term of this patent is extended or adjusted under 35 U.S.C. 154(b) by 137 days.

(21) Appl. No.: 15/380,177

(22) Filed: Dec. 15, 2016

Related U.S. Application Data

(60) Provisional application No. 62/326,498, filed on Apr. 22, 2016.

(51) Int. Cl.

| | |
|---|---|
| ***B65D 83/24*** | (2006.01) |
| ***B65D 85/72*** | (2006.01) |
| ***B65D 1/02*** | (2006.01) |
| ***B65D 83/20*** | (2006.01) |
| ***B65D 83/48*** | (2006.01) |
| ***B65D 83/14*** | (2006.01) |

(52) U.S. Cl.
CPC ..... *B65D 83/24* (2013.01); *B65D 1/02* (2013.01); *B65D 83/14* (2013.01); *B65D 83/20* (2013.01); *B65D 83/201* (2013.01); *B65D 83/202* (2013.01); *B65D 83/48* (2013.01); *B65D 85/72* (2013.01)

(58) Field of Classification Search
CPC .... B65D 83/24; B65D 83/202; B65D 83/201; B65D 83/72; B65D 83/20; B65D 83/14; B65D 83/48
USPC ..... 239/333, 337, 340, 345, 379; 222/153.11, 402.15
See application file for complete search history.

(56) References Cited

U.S. PATENT DOCUMENTS

| | | | | |
|---|---|---|---|---|
| 3,137,417 | A * | 6/1964 | Zetterstrom | A62C 13/003 222/402.15 |
| 4,417,673 | A * | 11/1983 | Hancock | B65D 83/208 222/153.11 |
| 2004/0063600 | A1* | 4/2004 | Williams | A47L 13/00 510/375 |
| 2008/0017674 | A1* | 1/2008 | Tsai | B65D 83/202 222/402.15 |

* cited by examiner

*Primary Examiner* — Steven J Ganey
(74) *Attorney, Agent, or Firm* — Plager Schack LLP; Mark H. Plager; Michael J. O'Brien

(57) ABSTRACT

A sparkling wine sprayer configured to spray a sparkling wine for recreational activities includes a bottle top sealing system pivotally and operatively coupled to a quick release lever to provide an airtight seal to a sparkling wine bottle. The bottle top sealing system is further connected to a tube that carries a sparkling wine through the sprayer. To use the sprayer, a top of the bottle is sealed by pulling the lever towards a user, attaching a top of the bottle to the bottle top sealing system and then pushing the lever back. The trigger is then pressed to that opens a valve in the tube and aligns the tube sections, allowing the sparkling wine to flow through the tube and spraying the sparkling wine through the nozzle. On the other hand, depressing the trigger stops spraying of the sparkling wine.

6 Claims, 4 Drawing Sheets

CHAMPAGNE SPRAYER

RELATED APPLICATION

This application claims priority to provisional patent application U.S. Ser. No. 62/326,498 filed on Apr. 22, 2016, the entire contents of which is herein incorporated by reference.

BACKGROUND

The embodiments herein relate generally to a sparkling wine sprayer for use in recreational activities.

Prior to embodiments of the disclosed invention the sparkling wine sprayers did not allow controlled and prolonged spraying. Further, the sprayers were not configured to hold a sparkling wine bottle in upside down position. Furthermore, the operation of such sprayers required both hands that poses difficulty in balancing the bottle. Embodiments of the disclosed invention solve these problems.

As used in this application "sparkling wine" is a wine with significant levels of carbon dioxide in it, making it fizzy. The classic example of a sparkling wine is Champagne, which is exclusively produced in the Champagne region of France.

SUMMARY

A sparkling wine sprayer is configured to spray sparkling wine for recreational activities. The sparkling wine sprayer includes a bottle top sealing system pivotally and operatively coupled to a quick release lever to provide an airtight seal to a sparkling wine bottle. A bottle top sealing system is further connected to a tube that carries the sparkling wine through the sprayer. To use the sprayer, a top of the bottle is sealed by pulling the lever towards a user, attaching a top of the bottle to the bottle top sealing system and then pushing the lever back. The trigger is then pressed to open a valve in the tube and align the tube sections. This allows the sparkling wine to flow through the tube and spray through the nozzle. On the other hand, releasing the trigger stops spraying of the sparkling wine.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
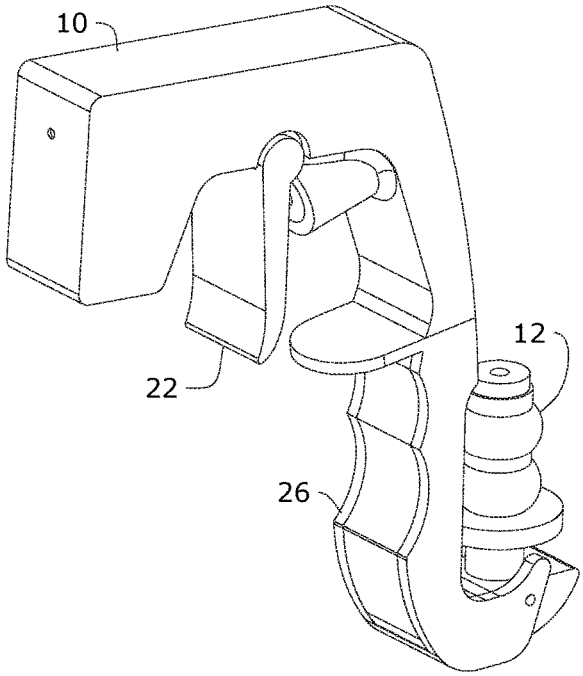
FIG. 1 shows a perspective view of one embodiment of the present invention.
Figure 2:
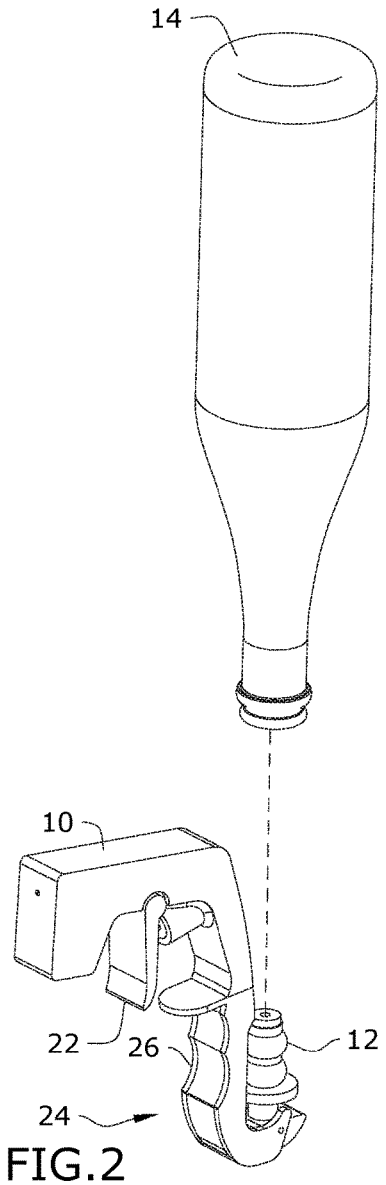
FIG. 2 shows an exploded view of the present invention.
Figure 3:
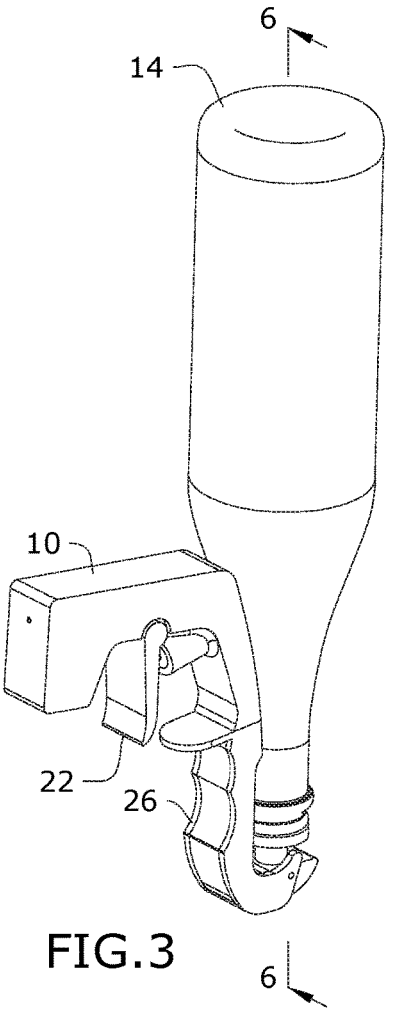
FIG. 3 shows a perspective view of the present invention.
Figure 4:
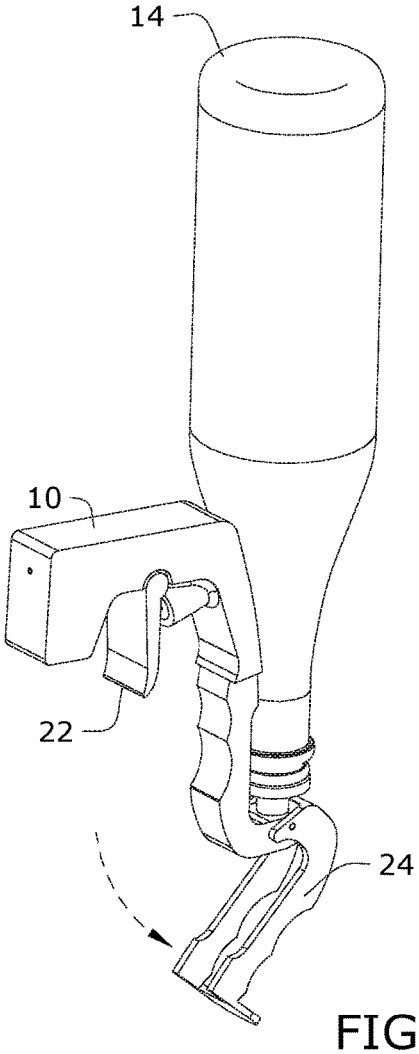
FIG. 4 shows a perspective view of the present invention shown with quick release lever in down position.
Figure 5:
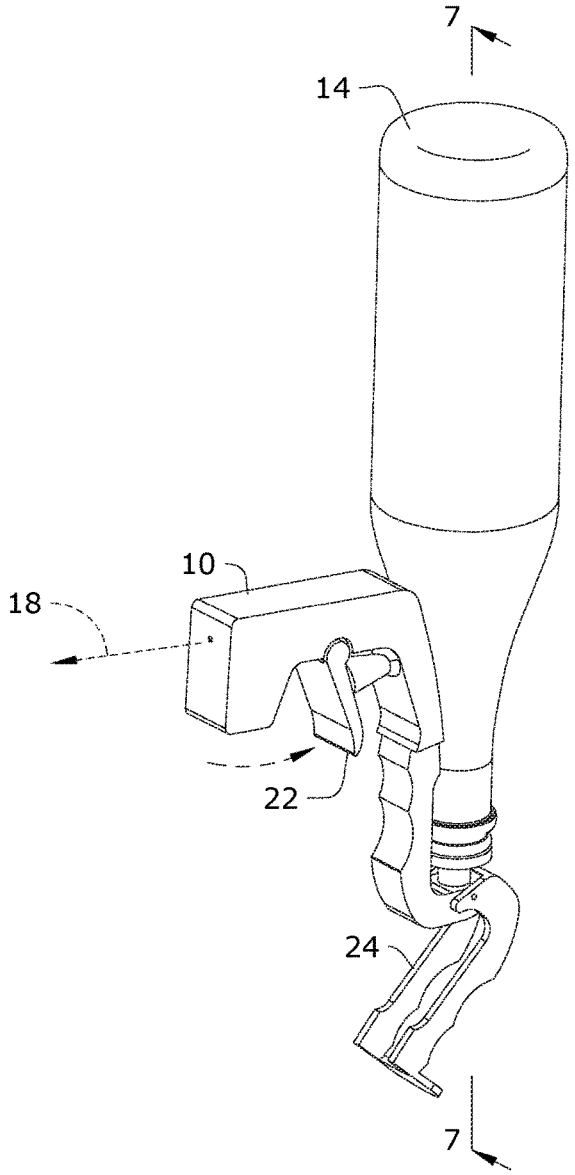
FIG. 5 shows a perspective view of the present invention shown with trigger in rear position.
Figure 6:
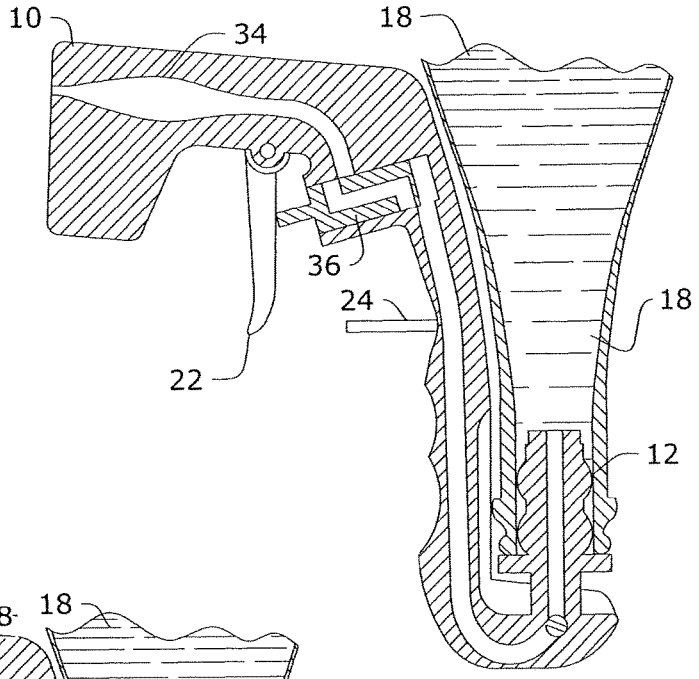
FIG. 6 shows a sectional view of the present invention taken along line 6-6 in FIG. 3.
Figure 7:
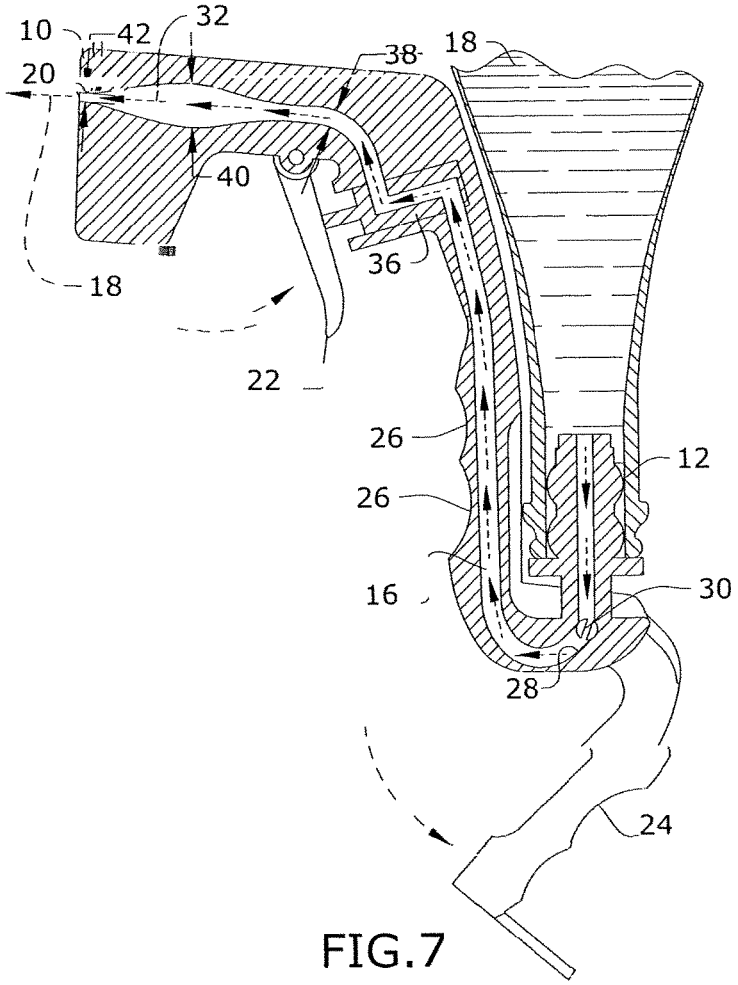
FIG. 7 shows a sectional view of the present invention taken along line 7-7 in FIG. 5.

By way of example, and referring to FIGS. 1-7, one embodiment of the present device comprises a sprayer body 10. The sprayer body comprises a bottle top sealing system

12, for attaching a sparkling wine bottle 14 to the device that is connected to a tube 16 which carries sparkling wine 18 and sprays the sparkling wine through a nozzle 20 when a trigger 22 is pressed. The bottle top sealing system provides an airtight seal that prevents gas to leak out of the bottle, thus ensuring prolonged spraying. Further, a quick release lever 24 is pivotally and operatively connected to the bottle top sealing system. When a user pulls the lever towards the user, the sealing system expands, conveniently displacing a top of the bottle which is then sealed by pushing the lever back to its original position. The quick release lever 24 and the sprayer body underneath the lever have a plurality of finger slots 26, providing a secure grip of the sprayer.

The bottle top sealing system is internally connected to the tube the sprayer body. The tube is further divided into three sections: a lever section 28 having a valve 30 and connected to the bottle top sealing system, a nozzle section 32 having the nozzle at one end and a middle section 34 between the two sections. These sections are unaligned and thus form the tube that is discontinuous. Furthermore, the trigger is attached to the sprayer body above the lever and it is operatively coupled to the middle section and the valve 36 in the tube. When the trigger is pressed, the valve opens and the three sections of the tube align to form a continuous tube that allows the sparkling wine to flow from the bottle through the nozzle. On the other hand, when the trigger is depressed the valve closes and the tube sections are unaligned, obstructing the flow of sparkling wine. In summary, to operate the sprayer the user attaches the bottle to the bottle top sealing system in upside down position and then presses the trigger to spray the sparkling wine. The nozzle 20 further comprises an opening inner diameter 38, a central inner diameter 40 and an exit inner diameter 42. The opening inner diameter 38 is approximately equal to the exit inner diameter 42. The central inner diameter 40 is approximately twice the opening inner diameter 38. The sprayer is operated by actuating a mechanical control by a user. The mechanical control further performs the following. First, pulling the lever towards the user. Then attaching a top of the bottle to the bottle top sealing system. Then, pushing the lever back. After that, pressing the trigger to open the valve and to align the tube sections to form a continuous tube. Following that, allowing the sparkling wine to flow through the tube. Finally, spraying through the nozzle while depressing the trigger stops spraying of the sparkling wine.

The device can be manufactured using materials, such as plastic and metal, that can withstand pressure up to 150 psi. The components of the device can be made by using a computer numerical control machine, 3-D printing and by casting a mold for injection molding. The trigger and the quick release lever are made of metal while the bottle top sealing system is made of stretchable material, such as silicone.

Accessories such as a pressure gauge, a camera and an extension system to add a plurality of the bottles, can be added to the sprayers.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A sparkling wine sprayer, configured to spray a sparkling wine for recreational activities comprising:

a bottle top sealing system, configured to provide an airtight seal to a sparkling wine bottle;

a quick release lever, pivotally and operatively coupled to the bottle top sealing system;

a tube for the sparkling wine to flow through, configured to have a nozzle section with a nozzle at one end, a lever section connected to the bottle top sealing system and a middle section between the nozzle section and the lever section;

a valve, positioned in the lever section of the tube to regulate flow of the sparkling wine through the tube; and a trigger, mechanically connected to a sprayer body and operatively coupled to the middle section of the tube, wherein the sprayer body is operated by actuating a mechanical control by a user.

2. The sparkling wine sprayer of claim 1, wherein the mechanical control operates as follows:

wherein the lever is pulled towards the user;

wherein a top of the bottle is attached to the bottle top sealing system;

wherein the lever is pushed back;

wherein the trigger is pressed to open the valve and to align the tube sections to form a continuous tube;

wherein the sparkling wine is allowed to flow through the tube; and wherein spraying through the nozzle while depressing the trigger stops spraying of the sparkling wine.

3. The sparkling wine sprayer of claim 1, wherein the quick release lever and the sprayer body underneath the lever further comprise a plurality of finger slots for securely holding the sprayer.

4. The sprayer of claim 3, wherein the opening inner diameter is approximately equal to the exit inner diameter.

5. The sprayer of claim 1, wherein the nozzle further comprises an opening inner diameter, a central inner diameter and an exit inner diameter.

6. The sprayer of claim 5, wherein the central inner diameter is approximately twice the opening inner diameter.

* * * * *